United States Patent [19]

Knight

[11] Patent Number: 4,654,763

[45] Date of Patent: Mar. 31, 1987

[54] POCKETBOOK LIGHT

[76] Inventor: Val R. Knight, 176 Ocean Ave., Jersey City, N.J. 07304

[21] Appl. No.: 805,782

[22] Filed: Dec. 6, 1985

[51] Int. Cl.[4] ..... A45C 15/06

[52] U.S. Cl. ..... 362/156

[58] Field of Search ..... 362/156, 157, 802; 200/42.01, 43.01, 43.09

[56] References Cited

U.S. PATENT DOCUMENTS

| | | | |
|---|---|---|---|
| 2,179,214 | 11/1939 | Hallbauer | 362/156 |
| 2,304,387 | 12/1942 | Whiting et al. | 362/156 |
| 3,307,027 | 2/1967 | Lins | 362/155 |
| 3,609,342 | 9/1971 | Wisniewski | 362/156 |
| 3,800,134 | 3/1974 | Castaldo | 362/156 |
| 3,976,871 | 8/1976 | Atherton | 362/156 |
| 4,084,085 | 4/1978 | Kim | 362/156 |
| 4,091,443 | 5/1978 | Ohrenstein | 362/156 |

FOREIGN PATENT DOCUMENTS

| | | | |
|---|---|---|---|
| 116830 | 6/1918 | United Kingdom | 362/156 |

*Primary Examiner*—Craig R. Feinberg
*Assistant Examiner*—David A. Okonsky
*Attorney, Agent, or Firm*—Richard L. Miller

[57] ABSTRACT

A pocketbook light for a compartment of a pocketbook is provided and consists of a housing removably secured by hook and loop pile strips within the compartment of the pocketbook so that a double activating switch in an on position will turn on a battery powered lamp to illuminate the compartment.

5 Claims, 6 Drawing Figures

POCKETBOOK LIGHT

BACKGROUND OF THE INVENTION

The instant invention relates generally to battery powered flash lights and more. Specifically it relates to a pocketbook light that is mounted within a compartment of the pocketbook to illuminate the contents therein.

SUMMARY OF THE INVENTION

A principle object of the present invention is to provide a pocketbook light that can be mounted within the compartment of the pocketbook with VELCRO® hook and loop pile fastener strips for easy installation.

Another object is to provide a pocketbook light that can be quickly operated by a double activating switch to instantly energize a lamp to illuminate the contents of the compartment within.

An additional object is to provide a pocketbook light that contains a receptacle having a snap on cover for holding two triple-A batteries for supplying the proper power to the lamp within.

A further object is to provide a pocketbook light that is simple and easy to use.

A still further object is to provide a pocketbook that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENT

Figure 1:
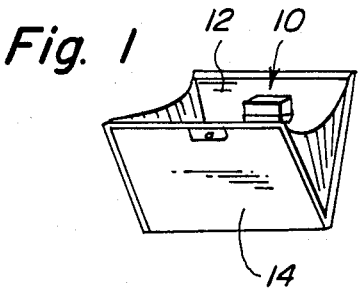
FIG. 1 is a perspective view of a pocketbook with the invention installed therein.
Figure 2:
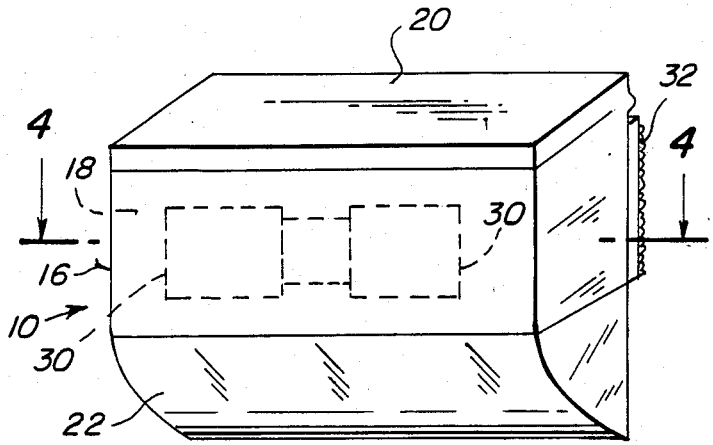
FIG. 2 is an enlarged perspective view of the invention per se.
Figure 3:
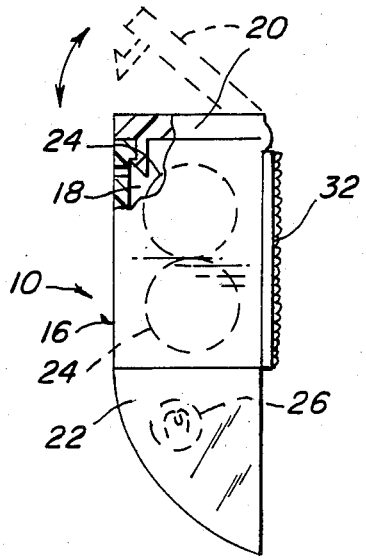
FIG. 3 is a side view thereof with parts broken away.
Figure 4:
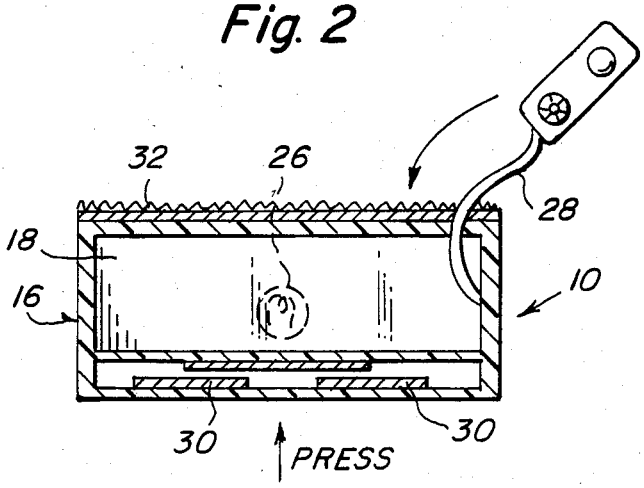
FIG. 4 is a cross sectional view taken along line 4—4 in FIG. 2.
Figure 5:
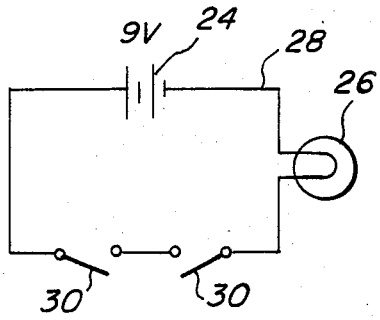
FIG. 5 is a schematic diagram of the electric circuit.

Turning now descriptively to the drawings in which similar reference characters denote similar elements throughout the several views, FIGS. 1 through 5 illustrate a pocketbook light 10 for a compartment 12 of a pocketbook 14.

The pocketbook light 10 contains a housing 16 that has a receptacle 18, a snap on cover 20 and a lens 22. A power source 24 being typically two triple-A batteries, or a conventional 9-V rectangular battery, is mounted within the receptacle 18 of the housing 16. A lamp 26 is mounted within the lens 22 of the housing 16 and is electrically connected via wires 28 to the power source 24.

A momentary double activating switch 30 to activate the lamp 26 is between the lamp and the power source 24 for switching the lamp 26 on and off assures that the lamp 26 will not be inadvertently activated by the contents of the pocketbook.

Hook and loop pile strips 32 are mounted between the housing 16 and the compartment 12 of the pocketbook 14 for removably securing the housing 16 within the compartment 12 when the switch 30 is in an on position the lamp 26 will illuminate the compartment 12.

Figure 6:
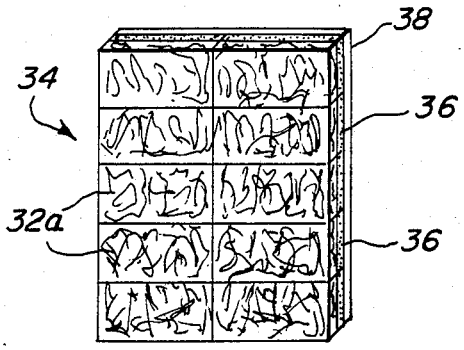
FIG. 6 is a perspective view of the hook and loop pile pad of strips with adhesive backing so that each strip can be removed and placed in a pocketbook so that the invention can be moved from one pocketbook to another quickly.

FIG. 6 shows a pad 34 of the hook and loop pile strips **32*a* with adhesive backing 36. A paper covering 38 is placed over the adhesive backing 36 for protection from soiling or the like. Each of the strips 32*a* can be removed and placed in different pocketbooks (not shown) thereby the pocketbook light 10** can be moved from one pocketbook to another quickly.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A pocketbook light for a compartment of a pocketbook which comprises:

(a) a housing having a receptacle, a snap on cover and a lens;

(b) a power source mounted within said receptacle of said housing;

(c) a lamp mounted within said lens of said housing and electrically connected with said power source;

(d) switching means between said lamp and said power source for switching said lamp on and off comprising at least two momentary double acting push button switches, both of which must be depressed to activate said lamp; and (e) means for removably securing said housing within said compartment of said pocketbook so that when said switching means is in an on position said lamp will illuminate said compartment.

2. A pocketbook light as recited in claim 1 wherein said removably securing means includes a hook and loop pile strips mounted between said housing and said compartment of said pocketbook.

3. A pocketbook light as recited in claim 2 further comprising a pad of said hook and loop pile strips with adhesive backing so that each of said strips can be removed and placed in different pocketbook whereby said pocketbook light can be moved from one pocketbook to another quickly.

4. A pocketbook light as recited in claim 3 wherein said power source comprises two triple-A batteries.

5. A pocketbook light as recited in claim 1 wherein said two momentary double activating push button switches are adjacent to each other and positioned adjacent an outer facing wall of said housing.

* * * * *